US009982386B2

(12) United States Patent
Chou et al.

(10) Patent No.: US 9,982,386 B2
(45) **Date of Patent: *May 29, 2018**

(54) ROPE STRUCTURE WITH IMPROVED BENDING FATIGUE AND ABRASION RESISTANCE CHARACTERISTICS

(71) Applicant: Samson Rope Technologies, Ferndale, WA (US)

(72) Inventors: Chia-Te Chou, Bellingham, WA (US); Danielle D. Stenvers, Ferndale, WA (US); Jonathan D. Miller, Lafayette, LA (US)

(73) Assignee: Samson Rope Technologies, Ferndale, WA (US)

( * ) Notice: Subject to any disclaimer, the term of this patent is extended or adjusted under 35 U.S.C. 154(b) by 434 days.

This patent is subject to a terminal disclaimer.

(21) Appl. No.: 14/792,935

(22) Filed: Jul. 7, 2015

(65) Prior Publication Data

US 2015/0308042 A1 Oct. 29, 2015

Related U.S. Application Data

(63) Continuation of application No. 13/732,294, filed on Dec. 31, 2012, now Pat. No. 9,074,318, which is a (Continued)

(51) Int. Cl.
*D07B 1/14* (2006.01)
*D07B 1/16* (2006.01)
(Continued)

(52) U.S. Cl.
CPC ..... *D07B 1/142* (2013.01); *D02G 3/36* (2013.01); *D07B 1/162* (2013.01); *D07B 7/145* (2013.01);
(Continued)

(58) Field of Classification Search
CPC ..... D02G 3/36; D07B 1/142; D07B 1/162; D07B 7/145
See application file for complete search history.

(56) References Cited

U.S. PATENT DOCUMENTS 429,174 A 6/1890 Ogilvy
568,531 A 9/1896 Harthan
(Continued)

FOREIGN PATENT DOCUMENTS

CA 2019499 2/2000
DE 7315621 10/1973
(Continued)

OTHER PUBLICATIONS

H. A. McKenna et al., "Handbook of fibre rope technology", 2004, pp. 88, 89, 100, Woodhead Publishing Limited, England, CRC Press LLC, USA.

(Continued)

*Primary Examiner* — Shaun R Hurley
(74) *Attorney, Agent, or Firm* — Michael R. Schacht; Schacht Law Office, Inc.

(57) ABSTRACT

A rope structure adapted to engage a bearing structure while under load comprises a plurality of fibers, a matrix, and lubricant particles. The plurality of fibers is adapted to bear the loads applied to the ends of the rope structure. The matrix surrounds at least a portion of some of the plurality of fibers. The lubricant particles are supported by the matrix such that at least some of the lubricant particles are arranged between at least some of the fibers to reduce friction between at least some of the plurality of fibers and at least some of the lubricant particles are arranged to be between the bearing structure and at least some of the plurality of fibers to reduce friction between the bearing structure and at least some of the plurality of fibers.

17 Claims, 4 Drawing Sheets

Related U.S. Application Data continuation of application No. 12/776,958, filed on May 10, 2010, now Pat. No. 8,341,930, which is a continuation-in-part of application No. 11/522,236, filed on Sep. 14, 2006, now Pat. No. 7,739,863.

(60) Provisional application No. 60/717,627, filed on Sep. 15, 2005.

(51) Int. Cl.
*D02G 3/36* (2006.01)
*D07B 7/14* (2006.01)

(52) U.S. Cl.
CPC ..... *D07B 2201/104* (2013.01); *D07B 2201/1096* (2013.01); *D07B 2205/2071* (2013.01); *D07B 2205/507* (2013.01)

(56) References Cited

U.S. PATENT DOCUMENTS 1,257,398 A 2/1918 Roach
1,479,865 A 1/1924 Metcalf
1,490,387 A 4/1924 Hansen
1,695,480 A 10/1926 Buoy
1,710,740 A 4/1929 Ljungkull
1,769,945 A 7/1930 Erkert
1,850,767 A 12/1930 Page
1,833,587 A 1/1931 Page
1,908,686 A 5/1933 Burke
1,931,808 A 10/1933 Andersen
2,070,362 A 2/1937 Kreutz
2,074,956 A 3/1937 Carstarphen
2,245,824 A 6/1941 Roesch
2,299,568 A 10/1942 Dickey
2,338,831 A 1/1944 Whitcomb et al.
2,359,424 A 10/1944 Joy
2,480,005 A 8/1949 Ewell
2,840,983 A 7/1958 Keilbach
2,960,365 A 11/1960 Meisen
3,035,476 A 5/1962 Fogden
3,073,209 A 1/1963 Benk et al.
3,276,810 A 10/1966 Antell
3,358,434 A 12/1967 McCann
3,367,095 A 2/1968 Field, Jr.
3,371,476 A 3/1968 Costello et al.
3,383,849 A 5/1968 Stirling
3,411,400 A 11/1968 Morieras et al.
3,415,052 A 12/1968 Stanton
3,425,737 A 2/1969 Sutton
RE26,704 E 11/1969 Norton
3,481,134 A 12/1969 Whewell, Jr.
3,507,949 A 4/1970 Campbell
3,537,742 A 11/1970 Black
3,561,318 A 2/1971 Andriot, Jr.
3,653,295 A 4/1972 Pintard
3,662,533 A 5/1972 Snellman et al.
3,718,945 A 3/1973 Brindejonc de Treglode
3,729,920 A 5/1973 Sayers et al.
3,762,865 A 10/1973 Weil
3,771,305 A 11/1973 Barnett
3,839,207 A 10/1974 Weil
3,854,767 A 12/1974 Burnett
3,904,458 A 9/1975 Wray
3,906,136 A 9/1975 Weil
3,915,618 A 10/1975 Feucht et al.
3,943,644 A 3/1976 Walz
3,957,923 A 5/1976 Burke
3,968,725 A 7/1976 Holzhauer
3,977,172 A 8/1976 Kerawalla
3,979,545 A 9/1976 Braus et al.
4,022,010 A 5/1977 Gladenbeck et al.
4,031,121 A 6/1977 Brown
4,036,101 A 7/1977 Burnett
4,050,230 A 9/1977 Senoo et al.
4,056,928 A 11/1977 de Vries
4,099,750 A 7/1978 McGrew
4,116,481 A 9/1978 Raue
4,155,394 A 5/1979 Shepherd et al.
4,159,618 A 7/1979 Sokaris
4,170,921 A 10/1979 Repass
4,173,113 A 11/1979 Snellman et al.
4,184,784 A 1/1980 Killian
4,195,113 A 3/1980 Brook
4,202,164 A 5/1980 Simpson et al.
4,210,089 A 7/1980 Lindahl
4,226,035 A 10/1980 Saito
4,228,641 A 10/1980 O'Neil
4,232,619 A 11/1980 Lindahl
4,232,903 A 11/1980 Welling et al.
4,250,702 A 2/1981 Gundlach
4,257,221 A 3/1981 Feinberg
4,258,608 A 3/1981 Brown
4,286,429 A 9/1981 Lin
4,312,260 A 1/1982 Morieras
4,321,854 A 3/1982 Foote et al.
4,329,794 A 5/1982 Rogers
4,350,380 A 9/1982 Williams
4,375,779 A 3/1983 Fischer
4,403,884 A 9/1983 Barnes
4,412,474 A 11/1983 Hara
4,421,352 A 12/1983 Raue et al.
4,464,812 A 8/1984 Crook, Jr. et al.
4,500,593 A 2/1985 Weber
4,509,233 A 4/1985 Shaw
4,534,163 A 8/1985 Schuerch
4,534,262 A 8/1985 Swenson
4,563,869 A 1/1986 Stanton
4,606,183 A 8/1986 Riggs
4,619,108 A 10/1986 Hotta
4,635,989 A 1/1987 Tremblay et al.
4,640,179 A 2/1987 Cameron
4,642,854 A 2/1987 Kelly et al.
4,674,801 A 6/1987 DiPaola et al.
4,677,818 A 7/1987 Honda et al.
4,757,719 A 7/1988 Franke
4,762,583 A 8/1988 Kaempen
4,779,411 A 10/1988 Kendall
4,784,918 A 11/1988 Klett et al.
4,850,629 A 7/1989 St. Germain
4,856,837 A 8/1989 Hammersla, Jr.
4,868,041 A 9/1989 Yamagishi et al.
4,887,422 A 12/1989 Klees et al.
4,947,917 A 8/1990 Noma et al.
4,958,485 A 9/1990 Montgomery et al.
4,974,488 A 12/1990 Spralja
4,978,360 A 12/1990 Devanathan
5,060,466 A 10/1991 Matsuda et al.
5,091,243 A 2/1992 Tolbert et al.
5,141,542 A 8/1992 Fangeat et al.
5,178,923 A 1/1993 Andrieu et al.
5,211,500 A 5/1993 Takaki et al.
D338,171 S 8/1993 Bichi
5,240,769 A 8/1993 Ueda et al.
5,288,552 A 2/1994 Hollenbaugh, Jr. et al.
5,296,292 A 3/1994 Butters
5,327,714 A 7/1994 Stevens et al.
5,333,442 A 8/1994 Berger
5,378,522 A 1/1995 Lagomarsino
5,426,788 A 6/1995 Meltzer
5,429,869 A 7/1995 McGregor et al.
5,441,790 A 8/1995 Ratigan
5,483,911 A 1/1996 Kubli
5,497,608 A 3/1996 Matsumoto et al.
5,501,879 A 3/1996 Murayama
5,506,043 A 4/1996 Lilani
5,525,003 A 6/1996 Williams et al.
5,636,506 A 6/1997 Yngvesson
5,643,516 A 7/1997 Raza et al.
5,651,572 A 7/1997 St. Germain
5,669,214 A 9/1997 Kopanakis
5,699,657 A 12/1997 Paulson
5,711,243 A 1/1998 Dunham
5,718,532 A 2/1998 Mower

(56) References Cited

U.S. PATENT DOCUMENTS

| | | | |
|---|---|---|---|
| 5,727,833 | A | 3/1998 | Coe |
| 5,802,839 | A | 9/1998 | Van Hook |
| 5,822,791 | A | 10/1998 | Baris |
| 5,826,421 | A | 10/1998 | Wilcox et al. |
| 5,852,926 | A | 12/1998 | Breedlove |
| 5,873,758 | A | 2/1999 | Mullins |
| 5,904,438 | A | 5/1999 | Vaseghi et al. |
| 5,931,076 | A | 8/1999 | Ryan |
| 5,943,963 | A | 8/1999 | Beals |
| 5,978,638 | A | 11/1999 | Tanaka et al. |
| 6,015,618 | A | 1/2000 | Orima |
| 6,033,213 | A | 3/2000 | Halvorsen, Jr. |
| 6,045,571 | A | 4/2000 | Hill et al. |
| 6,085,628 | A | 7/2000 | Street et al. |
| 6,122,847 | A | 9/2000 | Treu et al. |
| 6,146,759 | A | 11/2000 | Land |
| 6,164,053 | A | 12/2000 | O'Donnell et al. |
| 6,265,039 | B1 | 7/2001 | Drinkwater et al. |
| 6,295,799 | B1 | 10/2001 | Baranda |
| 6,341,550 | B1 | 1/2002 | White |
| 6,365,070 | B1 | 4/2002 | Stowell et al. |
| 6,405,519 | B1 | 6/2002 | Shaikh et al. |
| 6,410,140 | B1 | 6/2002 | Land et al. |
| 6,422,118 | B1 | 7/2002 | Edwards |
| 6,484,423 | B1 | 11/2002 | Murray |
| 6,524,690 | B1 | 2/2003 | Dyksterhouse |
| 6,575,072 | B2 | 6/2003 | Pellerin |
| 6,592,987 | B1 | 7/2003 | Sakamoto et al. |
| 6,601,378 | B1 | 8/2003 | Fritsch et al. |
| 6,704,535 | B2 | 3/2004 | Kobayashi et al. |
| 6,876,798 | B2 | 4/2005 | Triplett et al. |
| 6,881,793 | B2 | 4/2005 | Sheldon et al. |
| 6,916,533 | B2 | 7/2005 | Simmelink et al. |
| 6,945,153 | B2 | 9/2005 | Knudsen et al. |
| 7,051,664 | B2 | 5/2006 | Robichaud et al. |
| 7,093,416 | B2 | 8/2006 | Johnson et al. |
| 7,127,878 | B1 | 10/2006 | Wilke et al. |
| 7,134,267 | B1 | 11/2006 | Gilmore et al. |
| 7,137,617 | B2 | 11/2006 | Sjostedt |
| 7,165,485 | B2 | 1/2007 | Smeets et al. |
| 7,168,231 | B1 | 1/2007 | Chou et al. |
| 7,172,878 | B1 | 2/2007 | Nowak et al. |
| 7,182,900 | B2 | 2/2007 | Schwamborn et al. |
| 7,296,394 | B2 | 11/2007 | Clough et al. |
| 7,331,269 | B2 | 2/2008 | He et al. |
| 7,367,176 | B1 | 5/2008 | Gilmore et al. |
| 7,415,783 | B2 | 8/2008 | Huffman et al. |
| 7,437,869 | B1 | 10/2008 | Chou et al. |
| 7,472,502 | B2 | 1/2009 | Gregory et al. |
| 7,475,926 | B2 | 1/2009 | Summars |
| 7,568,419 | B2 | 8/2009 | Bosman |
| 7,637,549 | B2 | 12/2009 | Hess |
| 7,681,934 | B2 | 3/2010 | Harada et al. |
| 7,735,308 | B1 | 6/2010 | Gilmore et al. |
| 7,739,863 | B1 | 6/2010 | Chou et al. |
| 7,743,596 | B1 | 6/2010 | Chou et al. |
| 7,784,258 | B2 | 8/2010 | Hess |
| 8,171,713 | B2 | 5/2012 | Gilmore et al. |
| 8,341,930 | B1 | 1/2013 | Chou et al. |
| 8,707,668 | B2 | 4/2014 | Gilmore et al. |
| 9,074,318 | B2 | 7/2015 | Chou et al. |
| 9,404,203 | B2 | 8/2016 | Gilmore et al. |
| 9,573,661 | B1 | 2/2017 | Plaia et al. |
| 2003/0200740 | A1 | 10/2003 | Tao et al. |
| 2003/0226347 | A1 | 12/2003 | Smith et al. |
| 2004/0025486 | A1 | 2/2004 | Takiue |
| 2004/0069132 | A1 | 4/2004 | Knudsen et al. |
| 2005/0036750 | A1 | 2/2005 | Triplett et al. |
| 2005/0172605 | A1 | 8/2005 | Vancompernolle et al. |
| 2005/0279074 | A1 | 12/2005 | Johnson et al. |
| 2006/0048494 | A1 | 3/2006 | Wetzels et al. |
| 2006/0048497 | A1 | 3/2006 | Bloch |
| 2006/0115656 | A1 | 6/2006 | Martin |
| 2006/0179619 | A1 | 8/2006 | Pearce et al. |
| 2006/0213175 | A1 | 9/2006 | Smith et al. |
| 2007/0079695 | A1 | 4/2007 | Bucher et al. |
| 2007/0137163 | A1 | 6/2007 | Hess |
| 2007/0144134 | A1 | 6/2007 | Kajihara |
| 2009/0047475 | A1 | 2/2009 | Jeon |
| 2011/0097530 | A1 | 4/2011 | Gohil et al. |
| 2014/0000233 | A1 | 1/2014 | Chou et al. |
| 2014/0230635 | A1 | 8/2014 | Gilmore et al. |
| 2016/0376732 | A1 | 12/2016 | Gilmore et al. |

FOREIGN PATENT DOCUMENTS

| | | |
|---|---|---|
| EP | 1397304 | 5/2008 |
| FR | 2197392 | 3/1974 |
| GB | 312464 | 5/1929 |
| JP | 469565 | 4/1971 |
| JP | 557161116 | 10/1982 |
| JP | 1260080 | 10/1989 |
| JP | 2242987 | 9/1990 |
| JP | 3033285 | 4/2000 |
| JP | 2000212884 | 8/2000 |
| JP | 2004126505 | 4/2004 |
| KR | 1019900010144 | 7/1990 |
| RU | 2100674 | 12/1997 |
| RU | 2295144 | 10/2007 |
| SU | 618061 | 7/1978 |
| SU | 1647183 | 5/1991 |
| WO | 03102295 | 12/2003 |
| WO | 2004021771 | 3/2004 |
| WO | 2005075559 | 8/2005 |

OTHER PUBLICATIONS

Herzog Braiding Machines, "Rope Braiding Machines Seng 140 Series", predates 2004, 2 pages.

Herzog Braiding Machines, "Rope Braiding Machines Seng 160 Series", predates 2004, 2 pages.

International Searching Authority, ISR PCT/US2014020529, dated Jun. 10, 2014, 7 pages.

International Searching Authority, ISR PCT/US2014023749, dated Jun. 26, 2014, 7 pages.

International Searching Authority, ISR PCTUS2012039460, dated Sep. 13, 2012, 7 pages.

Pultrusion Industry Council, http://www.acmanet.org/pic/products/description.htm, "products & process: process description", 2001, 2 pages.

Samson Rope Technologies, Inc., "Dynalene Installation Instructions for Covering 12-Strand Rope", 2005, 12 pages.

Samson Rope Technologies, Inc., "Samson Deep Six Performs Beyond Expectation", Sep. 10, 2008, 2 pages.

Samson Rope Technologies, Inc., "Samson Offshore Expansion Celebrated", Feb. 18, 2009, 2 pages.

SLO, Amendment After NOA, U.S. Appl. No. 12/243,079, dated Jan. 3, 2011, 4 pages.

SLO, RCE, U.S. Appl. No. 12/466,237, dated Sep. 16, 2011, 1 page.

SLO, Response, U.S. Appl. No. 12/243,079, dated Oct. 28, 2010, 13 pages.

SLO, Response, U.S. Appl. No. 12/463,284, dated Jul. 8, 2011, 12 pages.

SLO, Response, U.S. Appl. No. 12/466,237, dated Jun. 10, 2011, 15 pages.

SLO, Response, U.S. Appl. No. 12/815,363, dated May 23, 2011, 9 pages.

USPTO, Issue Notification, U.S. Appl. No. 12/243,079, dated Mar. 2, 2011, 1 page.

USPTO, Notice of Allowance and Issue Fee Due, U.S. Appl. No. 12/466,237, dated Jun. 29, 2011, 6 pages.

USPTO, Notice of Allowance, U.S. Appl. No. 12/243,079, dated Nov. 8, 2010, 16 pages.

USPTO, Office Action, U.S. Appl. No. 11/522,236, dated Aug. 24, 2009, 7 pages.

USPTO, Office Action, U.S. Appl. No. 11/522,236, dated Feb. 17, 2010, 3 pages.

USPTO, Office Action, U.S. Appl. No. 12/243,079, dated Jun. 28, 2010, 8 pages.

(56) References Cited

OTHER PUBLICATIONS

USPTO, Office Action, U.S. Appl. No. 12/463,284, dated Apr. 8, 2011, 13 pages.
USPTO, Office Action, U.S. Appl. No. 12/466,237, dated Mar. 10, 2011, 10 pages.
USPTO, Office Action, U.S. Appl. No. 12/815,363, dated Aug. 15, 2011, 6 pages.
USPTO, Office Action, U.S. Appl. No. 12/815,363, dated Feb. 22, 2011, 10 pages.

ROPE STRUCTURE WITH IMPROVED BENDING FATIGUE AND ABRASION RESISTANCE CHARACTERISTICS

RELATED APPLICATIONS

This application, U.S. patent application Ser. No. 14/792,935 filed Jul. 7, 2015 is a continuation of U.S. patent application Ser. No. 13/732,294 filed Dec. 31, 2012, now U.S. Pat. No. 9,074,318, which issued on Jul. 7, 2015.

U.S. patent application Ser. No. 13/732,294 filed on Dec. 31, 2012, is a continuation of U.S. patent application Ser. No. 12/776,958 filed May 10, 2010, now U.S. Pat. No. 8,341,930, which issued on Jan. 1, 2013.

U.S. patent application Ser. No. 12/776,958 is a continuation-in-part of U.S. patent application Ser. No. 11/522,236 filed Sep. 14, 2006, now U.S. Pat. No. 7,739,863, which issued on Jun. 22, 2010.

U.S. patent application Ser. No. 11/522,236 claims benefit of U.S. Provisional Patent Application Ser. No. 60/717,627 filed Sep. 15, 2005.

The subject matter of the foregoing related applications are incorporated herein by reference.

TECHNICAL FIELD

The present invention relates to rope systems and methods and, in particular, to ropes that are coated to improve the resistance of the rope to bending fatigue.

BACKGROUND

The characteristics of a given type of rope determine whether that type of rope is suitable for a specific intended use. Rope characteristics include breaking strength, elongation, flexibility, weight, bending fatigue resistance and surface characteristics such as abrasion resistance and coefficient of friction. The intended use of a rope will determine the acceptable range for each characteristic of the rope. The term "failure" as applied to rope will be used herein to refer to a rope being subjected to conditions beyond the acceptable range associated with at least one rope characteristic.

The present invention relates to ropes that are commonly referred to in the industry as "lift lines". Lift lines are used to deploy (lower) or lift (raise) submersible equipment used for deep water exploration. Bending fatigue and abrasion resistance characteristics are highly important in the context of lift lines.

In particular, a length of lift line is connected at a first end to an on-board winch or capstan and at a second end to the submersible equipment. Between the winch and the submersible equipment, the lift line passes over or is wrapped around one or more intermediate structural members such as a closed chock, roller chock, bollard or bit, staple, bullnose, cleat, a heave compensating device, or a constant tensioning device.

When loads are applied to the lifting line, the lifting line wraps around such intermediate structural members and is thus subjected to bending fatigue and abrasion at the intermediate structural members. Abrasion and heat generated by friction at the point of contact between the lifting line and the intermediate structural members can create wear on the lifting line that can affect the performance of the lifting line and possibly lead to failure thereof.

The need thus exists for improved ropes for use as lifting lines that have improved bending fatigue and abrasion resistance characteristics.

SUMMARY

The present invention may be embodied as a rope structure adapted to engage a bearing structure while under load comprising a plurality of fibers, a matrix, and lubricant particles. The plurality of fibers is adapted to bear the loads applied to the ends of the rope structure. The matrix surrounds at least a portion of some of the plurality of fibers. The lubricant particles are supported by the matrix such that at least some of the lubricant particles are arranged between at least some of the fibers to reduce friction between at least some of the plurality of fibers and at least some of the lubricant particles are arranged to be between the bearing structure and at least some of the plurality of fibers to reduce friction between the bearing structure and at least some of the plurality of fibers.

A method of forming a rope structure adapted to engage a bearing structure while loads are applied to ends of the rope structure comprises the following steps. A plurality of fibers is provided. The plurality of fibers are combined such that the fibers are capable of bearing the loads applied to the ends of the rope structure. A liquid coating is formed by arranging lubricant particles within a binder. The liquid coating is applied to the plurality fibers such that at least some of the lubricant particles are arranged between at least some of the fibers and at least some of the fibers are arranged around at least some of the plurality of fibers. The liquid coating is allowed to dry to form a matrix that supports the lubricant particles such that friction between at least some of the plurality of fibers is reduced and friction between the bearing structure and at least some of the plurality of fibers is reduced.

The present invention may also be embodied as a rope structure adapted to engage a bearing structure while loads are applied to ends of the rope structure, comprising a plurality of fibers and a matrix comprising binder and lubricant particles. The plurality of fibers is adapted to bear the loads applied to the ends of the rope structure, where the plurality of fibers are combined to form a plurality of yarns, the plurality of yarns are combined to form a plurality of strands, and the plurality of strands are combined to form a primary strength component. The matrix lubricant particles are suspended within the matrix such that the binder fixes the particles relative to at least some of the fibers such that the particles reduce friction between at least some of the plurality of fibers and between at least some of the plurality of fibers and the bearing structure.

DETAILED DESCRIPTION

Figure 1A:
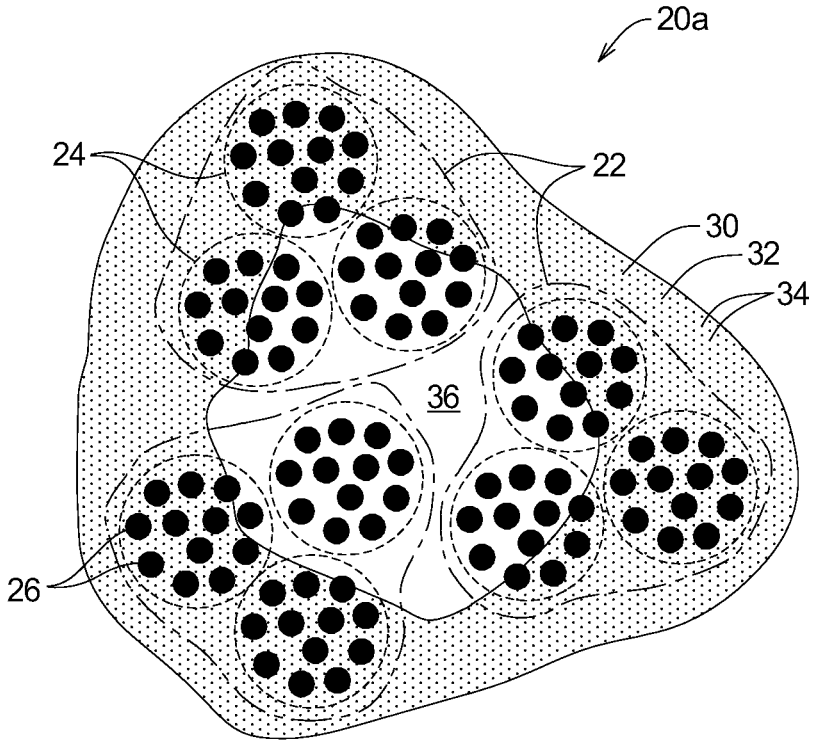
FIGS. 1A and 1B are schematic cut-away views of example ropes constructed in accordance with, and embodying, the principles of the present invention.
Figure 1B:
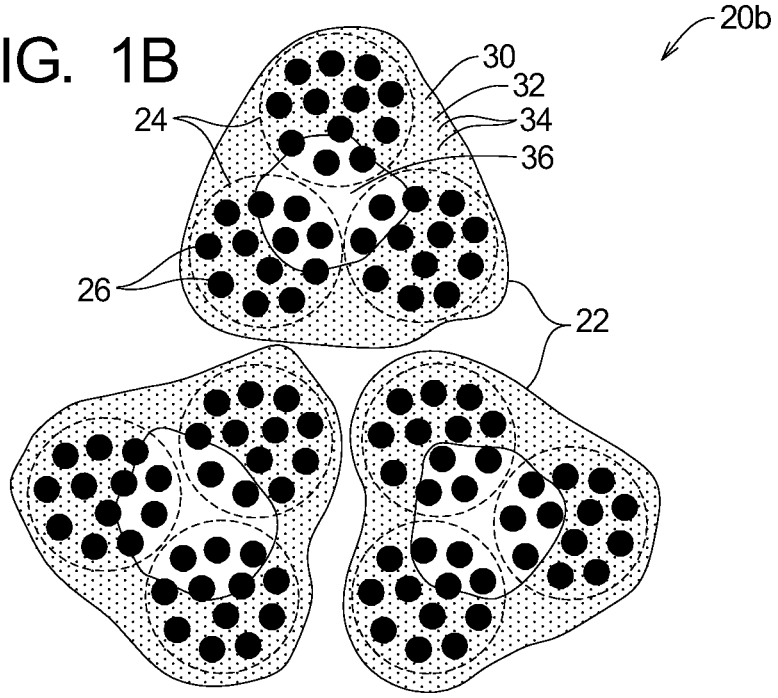

Referring initially to FIGS. 1A and 1B of the drawing, depicted in cross-section therein are rope structures 20*a* and 20*b* constructed in accordance with, and embodying, the principles of the present invention. The rope structures 20*a* and 20*b* are each formed by one or more plys or strands 22. The plys or strands 22 are formed by one or more yarns 24. The yarns 24 are formed by a plurality of fibers 26. By way of example, the fibers 26 may be twisted together to form the yarns 24, the yarns 24 twisted to form the plys or strands 22, and the strands 22 braided or twisted to form the rope structure 20*a* or 20*b*.

In addition, the example rope structures 20*a* and 20*b* each comprises a coating 30 that is applied either to the entire rope structure (FIG. 1A) or to the individual strands (FIG. 1B). In the example rope structures 20*a* and 20*b*, coating material is applied in liquid form and then allowed to dry to form the coating 30. The coating 30 comprises a binder portion 32 (solid matrix) and a lubricant portion 34 (e.g., suspended particles). The binder portion 32 adheres to or suspends the fibers 26 to hold the lubricant portion 34 in place adjacent to the fibers 26. More specifically, the coating 30 forms a layer around at least some of the fibers 26 that arranges the lubricant portion 34 between at least some of the adjacent fibers 26 and between the fibers 26 and any external structural members in contact with the rope structure 20*a* or 20*b*.

The fibers 26 are combined to form the primary strength component of the rope structures 20*a* and 20*b*. The lubricant portion 34 of the coating 30 is supported by the binder portion 32 to reduce friction between adjacent fibers 26 as well as between the fibers 26 and any external structural members in contact with the rope structure 20*a* or 20*b*. The lubricant portion 34 of the coating 30 thus reduces fatigue on the fibers 26 when the rope structures 20*a* or 20*b* are bent around external structures. Without the lubricant portion 34 of the coating 30, the fibers 26 would abrade each other, increasing bending fatigue on the entire rope structure 20*a* or 20*b*. The lubricant portion 34 of the coating 30 further reduces friction between the fibers 26 and any external structural members, thereby increasing abrasion resistance of the rope structures 20*a* and 20*b*.

With the foregoing understanding of the basic construction and characteristics of the rope structures 20*a* and 20*b* of the present invention in mind, the details of construction and composition of the rope structures 20 will now be described.

In the liquid form, the coating material comprises at least a carrier portion, the binder portion, and the lubricant portion. The carrier portion maintains the liquid form of the coating material in a flowable state. However, the carrier portion evaporates when the wet coating material is exposed to the air, leaving the binder portion 32 and the lubricant portion 34 to form the coating 30. When the coating material has dried to form the coating 30, the binder portion 32 adheres to the surfaces of at least some of the fibers 26, and the lubricant portion 34 is held in place by the binder portion 32. The coating material is solid but not rigid when dried as the coating 30.

In the example rope structures 20*a* and 20*b*, the coating material is formed by a mixture comprising a base forming the carrier portion and binder portion and PolyTetraFluoro-Ethylene (PTFE) forming the lubricant portion. The base of the coating material is available from s.a. GOVI n.v. of Belgium under the tradename LAGO 45 and is commonly used as a coating material for rope structures. Alternative products that may be used as the base material include polyurethane dispersions; in any event, the base material should have the following properties: good adhesion to fiber, stickiness, soft, flexible. The base of the coating material is or may be conventional and will not be described herein in further detail.

The example lubricant portion 34 of the coating material is a solid material generically known as PTFE but is commonly referred to by the tradename Teflon. The PTFE used in the coating material of the example rope structures 20*a* and 20*b* is in powder form, although other forms may be used if available. The particle size of the PTFE should be within a first preferred range of approximately 0.10 to 0.50 microns on average but in any event should be within a second preferred range of 0.01 to 2.00 microns on average. The example rope structures 20*a* and 20*b* are formed by a PTFE available in the marketplace under the tradename PFTE30, which has an average particle size of approximately 0.22 microns.

The coating material used by the example rope structures 20*a* and 20*b* comprises PTFE within a first preferred range of approximately 32 to 37% by weight but in any event should be within a second preferred range of 5 to 40% by weight, with the balance being formed by the base. The example rope structures are formed by a coating material formed by approximately 35% by weight of the PTFE.

As an alternative to PTFE, the lubricant portion 34 may be formed by solids of other materials and/or by a liquid such as silicon oil. Other example materials that may form the lubricant portion 34 include graphite, silicon, molybdenum disulfide, tungsten disulfide, and other natural or synthetic oils. In any case, enough of the lubricant portion 34 should be used to yield an effect generally similar to that of the PTFE as described above.

The coating 30 is applied by dipping the entire rope structure 20*a* and/or individual strands 22 into or spraying the structure 20*a* and/or strands 22 with the liquid form of the coating material. The coating material is then allowed to dry on the strands 22 and/or rope structure 20*a*. If the coating 30 is applied to the entire rope structure 20*a*, the strands are braided or twisted before the coating material is applied. If the coating 30 is applied to the individual strands 22, the strands are braided or twisted to form the rope structure 20*b* after the coating material has dried.

In either case, one or more voids 36 in the coating 30 may be formed by absences of coating material. Both dipping and spraying are typically done in a relatively high speed, continuous process that does not allow complete penetration of the coating material into the rope structures 20*a* and 20*b*. In the example rope structure 20*a*, a single void 36 is shown in FIG. 1A, although this void 36 may not be continuous along the entire length of the rope structure 20*a*. In the example rope structure 20*b*, a void 36 is formed in each of the strands 22 forming the rope structure 20*b*. Again, the voids 36 formed in the strands 22 of the rope structure 20*b* need not be continuous along the entire length of the rope structure 20*a*.

In the example rope structures 20*a* and 20*b*, the matrix formed by the coating 30 does not extend through the entire volume defined by the rope structures 20*a* or 20*b*. In the example structures 20*a* and 20*b*, the coating 30 extends a first preferred range of approximately ¼ to ½ of the diameter of the rope structure 20*a* or the strands of the rope structure 20*b* but in any event should be within a second preferred range of approximately ⅛ to ¾ of the diameter of the rope structure 20*a* or the strands 22 of the rope structure 20*b*. In the example rope structures 20*a* and 20*b*, the coating matrix extends through approximately ⅓ of the diameter of the rope structure 20*a* or the strands 22 of the rope structure 20*b*.

In other embodiments, the matrix formed by the coating 30 may extend entirely through the entire diameter of rope structure 20*a* or through the entire diameter of the strands 22 of the rope structure 20*b*. In these cases, the rope structure 20*a* or strands 22 of the rope structure 20*b* may be soaked for a longer period of time in the liquid coating material. Alternatively, the liquid coating material may be forced into the rope structure 20*a* or strands 22 of the rope structure 20*b* by applying a mechanical or fluid pressure.

The following discussion will describe several particular example ropes constructed in accordance with the principles of the present invention as generally discussed above.

First Specific Rope Example

Figure 2:
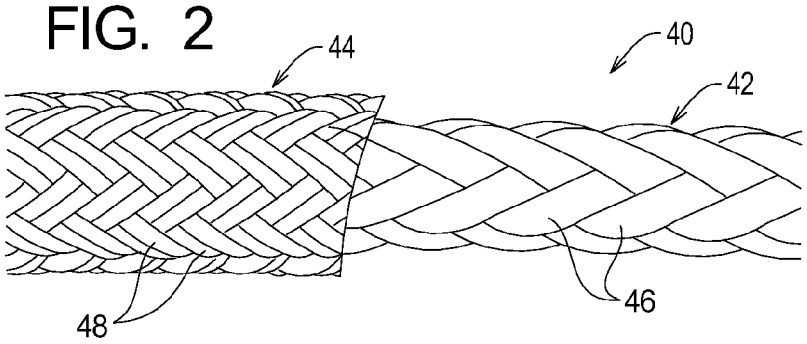
FIG. 2 is a side elevation view of a first example of a rope of the present invention.
Figure 3:
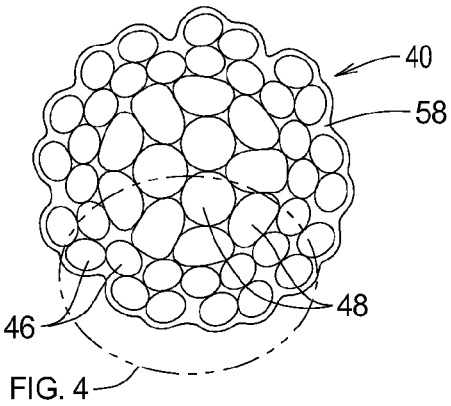
FIG. 3 is a radial cross-section of the rope depicted in FIG. 2.
Figure 4:
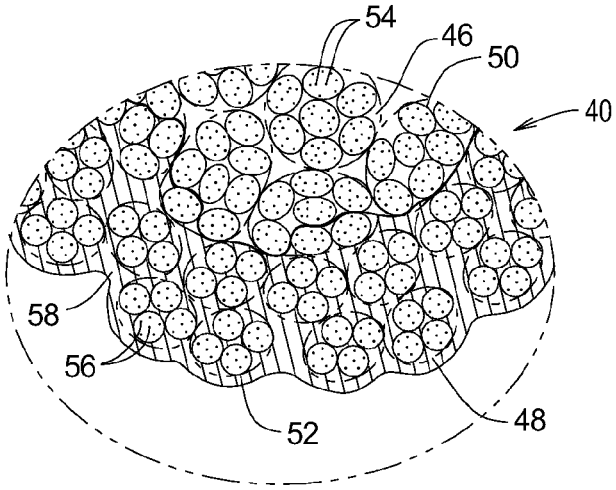
FIG. 4 is a close-up view of a portion of FIG. 3.

Referring now to FIGS. 2, 3, and 4, those figures depict a first specific example of a rope 40 constructed in accordance with the principles of the present invention. As shown in FIG. 2, the rope 40 comprises a rope core 42 and a rope jacket 44. FIG. 2 also shows that the rope core 42 and rope jacket 44 comprise a plurality of strands 46 and 48, respectively. FIG. 4 shows that the strands 46 and 48 comprise a plurality of yarns 50 and 52 and that the yarns 50 and 52 in turn each comprise a plurality of fibers 54 and 56, respectively. FIGS. 3 and 4 also show that the rope 40 further comprises a coating material 58 that forms a matrix that at least partially surrounds at least some of the fibers 54 and 56.

The exemplary rope core 42 and rope jacket 44 are formed from the strands 46 and 48 using a braiding process. The example rope 40 is thus the type of rope referred to in the industry as a double-braided rope. The strands 46 and 48 may be substantially identical in size and composition. Similarly, the yarns 50 and 52 may also be substantially identical in size and composition. However, strands and yarns of different sizes and compositions may be combined to form the rope core 42 and rope jacket 44. Additionally, the fibers 54 and 56 forming at least one of the yarns 50 and 52 may be of different types.

Second Rope Example

Figure 5:
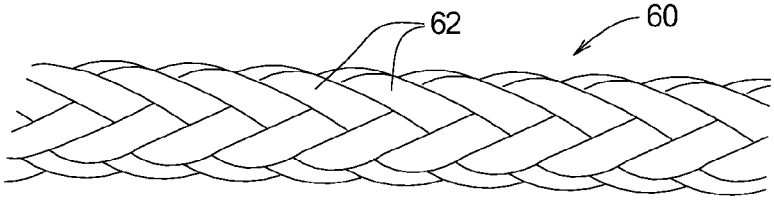
FIG. 5 is a side elevation view of a second example of a rope of the present invention.
Figure 6:
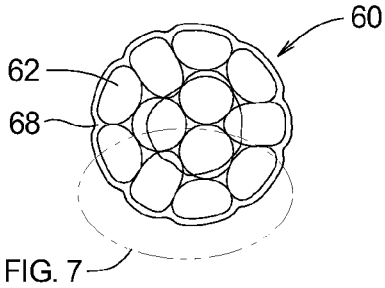
FIG. 6 is a radial cross-section of the rope depicted in FIG. 5.
Figure 7:
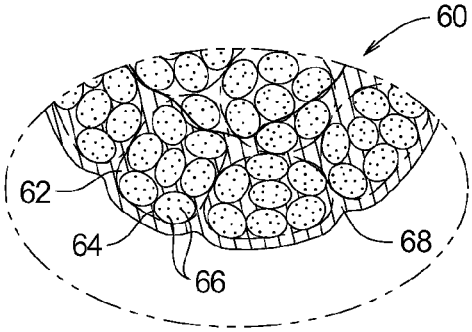
FIG. 7 is a close-up view of a portion of FIG. 6.

Referring now to FIGS. 5, 6, and 7, those figures depict a second example of a rope 60 constructed in accordance with the principles of the present invention. As perhaps best shown in FIG. 6, the rope 60 comprises a plurality of strands 62. FIG. 7 further illustrates that each of the strands 62 comprises a plurality of yarns 64 and that the yarns 64 in turn comprise a plurality of fibers 66. FIGS. 6 and 7 also show that the rope 60 further comprises a coating material 68 that forms a matrix that at least partially surrounds at least some of the fibers 66.

The strands 62 are formed by combining the yarns 64 using any one of a number of processes. The exemplary rope 60 is formed from the strands 62 using a braiding process. The example rope 60 is thus the type of rope referred to in the industry as a braided rope.

The strands 62 and yarns 64 forming the rope 60 may be substantially identical in size and composition. However, strands and yarns of different sizes and compositions may be combined to form the rope 60. In the example rope 60, the strands 62 (and thus the rope 60) may be 100% HMPE or a blend of 40-60% by weight of HMPE with the balance being Vectran.

Third Rope Example

Figure 8:
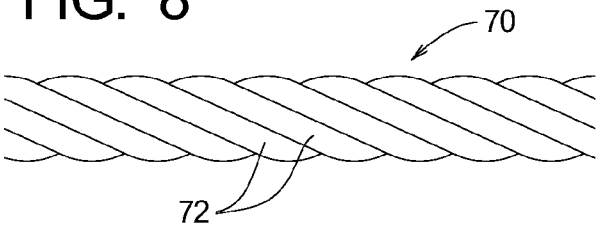
FIG. 8 is a side elevation view of a third example of a rope of the present invention.
Figure 9:
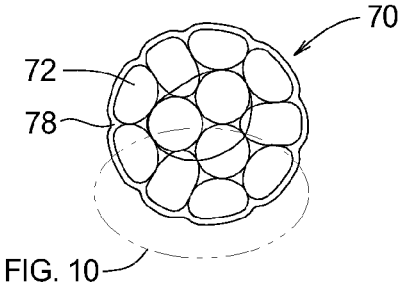
FIG. 9 is a radial cross-section of the rope depicted in FIG. 8.
Figure 10:
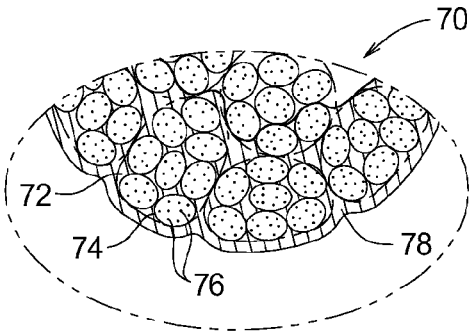
FIG. 10 is a close-up view of a portion of FIG. 9.

Referring now to FIGS. 8, 9, and 10, those figures depict a third example of a rope 70 constructed in accordance with the principles of the present invention. As perhaps best shown in FIG. 9, the rope 70 comprises a plurality of strands 72. FIG. 10 further illustrates that each of the strands 72 comprises a plurality of yarns 74, respectively. The yarns 74 are in turn comprised of a plurality of fibers 76. FIGS. 9 and 10 also show that the rope 70 further comprises a coating material 78 that forms a matrix that at least partially surrounds at least some of the fibers 76.

The strands 72 are formed by combining the yarns 74 using any one of a number of processes. The exemplary rope 70 is formed from the strands 72 using a twisting process. The example rope 70 is thus the type of rope referred to in the industry as a twisted rope.

The strands 72 and yarns 74 forming the rope 70 may be substantially identical in size and composition. However, strands and yarns of different sizes and compositions may be combined to form the rope 70.

Fourth Rope Example

Figure 11:
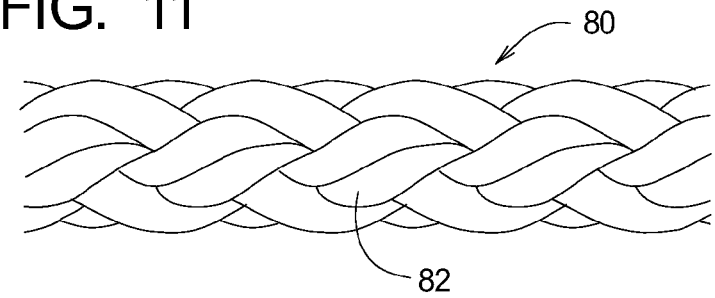
FIG. 11 is a side elevation view of a fourth example of a rope of the present invention.
Figure 12:
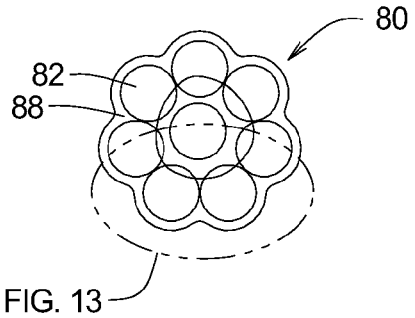
FIG. 12 is a radial cross-section of the rope depicted in FIG. 8.
Figure 13:
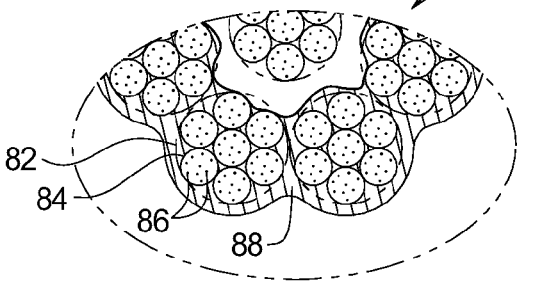
FIG. 13 is a close-up view of a portion of FIG. 12.

Referring now to FIGS. 11, 12, and 13, those figures depict a fourth example of a rope 80 constructed in accordance with the principles of the present invention. As perhaps best shown in FIG. 12, the rope 80 comprises a plurality of strands 82. FIG. 13 further illustrates that each of the strands 82 comprise a plurality of yarns 84 and that the yarns 84 in turn comprise a plurality of fibers 86, respectively. FIGS. 12 and 13 also show that the rope 80 further comprises a coating material 88 that forms a matrix that at least partially surrounds at least some of the fibers 86.

The strands 82 are formed by combining the yarns 84 using any one of a number of processes. The exemplary rope 80 is formed from the strands 82 using a braiding process. The example rope 80 is thus the type of rope commonly referred to in the industry as a braided rope.

The strands 82 and yarns 84 forming the rope 80 may be substantially identical in size and composition. However, strands and yarns of different sizes and compositions may be combined to form the rope 80. The first and second types of fibers are combined to form at least some of the yarns 84 are different as described above with reference to the fibers 24 and 28. In the example rope 80, the strands 82 (and thus the rope 80) may be 100% HMPE or a blend of 40-60% by weight of HMPE with the balance being Vectran.

Given the foregoing, it should be clear to one of ordinary skill in the art that the present invention may be embodied in other forms that fall within the scope of the present invention.

What is claimed is:

1. A rope structure adapted to engage a bearing structure while under load, comprising:

a plurality of fibers adapted to bear the loads applied to the ends of the rope structure;

a matrix that surrounds at least a portion of some of the plurality of fibers;

lubricant particles having an average size of within approximately 0.01 microns to 2.00 microns supported by the matrix such that at least some of the lubricant particles are arranged between at least some of the fibers to reduce friction between at least some of the plurality of fibers, and are arranged to be between the bearing structure and at least some of the plurality of fibers to reduce friction between the bearing structure and at least some of the plurality of fibers.

2. A rope structure as recited in claim 1, in which a liquid form of the coating material comprises substantially between 5% and 40% by weight of the lubricant particles.

3. A rope structure as recited in claim 2, in which the liquid form of the coating material comprises substantially between 32% and 37% by weight of the lubricant particles.

4. A rope structure as recited in claim 2, in which the liquid form of the coating material comprises approximately 35% by weight of the lubricant particles.

5. A rope structure as recited in claim 1, in which the lubricant portion is in powder form.

6. A rope structure as recited in claim 1, in which an average size of the particles forming the lubricant portion is within approximately 0.10 microns to 0.50 microns.

7. A rope structure as recited in claim 6, in which an average size of the particles is approximately 0.22 microns.

8. A rope structure as recited in claim 1, in which the matrix comprises binder portion that adheres to at least some of the fibers.

9. A rope structure as recited in claim 1, in which the matrix is formed of a polyurethane dispersion.

10. A method of forming a rope structure adapted to engage a bearing structure while loads are applied to ends of the rope structure, comprising the steps of:

providing a plurality of fibers;

combining the plurality of fibers such that the fibers are capable of bearing the loads applied to the ends of the rope structure;

forming a liquid coating by arranging lubricant particles having an average size of within approximately 0.01 microns to 2.00 microns within a binder;

applying the liquid coating to the plurality fibers such that at least some of the lubricant particles are arranged between at least some of the fibers, and are arranged around at least some of the plurality of fibers;

allowing the liquid coating to dry to form a matrix that supports the lubricant particles such that friction between at least some of the plurality of fibers is reduced, and friction between the bearing structure and at least some of the plurality of fibers is reduced.

11. A method as recited in claim 10, in which the step of forming the liquid coating comprises the step of combining the lubricant particles and the binder such that the coating material comprises substantially between 5% and 40% by weight of the lubricant particles.

12. A method as recited in claim 10, in which the step of providing a coating material comprises the step of formulating the coating material such that the binder portion adheres to at least some of the fibers.

13. A method as recited in claim 10, in which the step of providing the binder portion comprises the step of providing a polyurethane dispersion.

14. A rope structure adapted to engage a bearing structure while loads are applied to ends of the rope structure, comprising:

a plurality of fibers adapted to bear the loads applied to the ends of the rope structure, where the plurality of fibers are combined to form a plurality of yarns, the plurality of yarns are combined to form a plurality of strands, and the plurality of strands are combined to form a primary strength component;

a matrix comprising binder and lubricant particles suspended within the matrix such that the binder fixes the particles relative to at least some of the fibers such that the particles reduce friction between at least some of the plurality of fibers and between at least some of the plurality of fibers and the bearing structure, where an average size of the particles is within approximately 0.01 microns to 2.00 microns.

15. A rope structure as recited in claim 14, in which the binder adheres to the fibers such that particles are arranged between at least some of the fibers and between at least some of the fibers and the bearing structure.

16. A rope structure as recited in claim 14, in which the binder adheres to at least some of the fibers.

17. A rope structure as recited in claim 14, in which the matrix comprises a polyurethane dispersion.

* * * * *